US007044433B2

(12) United States Patent
Langham et al.

(10) Patent No.: US 7,044,433 B2
(45) Date of Patent: May 16, 2006

(54) VALVE SPRING MECHANISM

(75) Inventors: Graham Langham, Kibworth (GB); Timothy Harrop, Old (GB); Anthony Viccars, Desborough (GB); Rupert Russell, Kislingbury (GB)

(73) Assignee: Ilmor Engineering Limited, (GB)

( * ) Notice: Subject to any disclaimer, the term of this patent is extended or adjusted under 35 U.S.C. 154(b) by 9 days.

(21) Appl. No.: 10/475,963

(22) PCT Filed: Mar. 26, 2002

(86) PCT No.: PCT/GB02/01178

§ 371 (c)(1),
(2), (4) Date: Apr. 8, 2004

(87) PCT Pub. No.: WO02/086295

PCT Pub. Date: Oct. 31, 2002

(65) Prior Publication Data

US 2004/0164259 A1 Aug. 26, 2004

(30) Foreign Application Priority Data

Apr. 24, 2001 (GB) ..... 0110031

(51) Int. Cl.
*F01L 1/46* (2006.01)

(52) U.S. Cl. ..... 251/63.5; 123/90.14; 123/90.65

(58) Field of Classification Search ..... 251/62, 251/63.4–63.6; 123/90.14, 90.65–90.67
See application file for complete search history.

(56) References Cited

U.S. PATENT DOCUMENTS

| | | | | |
|---|---|---|---|---|
| 3,410,304 | A * | 11/1968 | Paul, Jr. | 137/494 |
| 5,713,315 | A * | 2/1998 | Jyoutaki et al. | 123/90.12 |
| 5,943,988 | A | 8/1999 | Burger et al. | |
| 5,988,124 | A | 11/1999 | Duesmann | |
| 6,508,453 | B1 * | 1/2003 | Mamyo | 251/63.5 |
| 6,866,059 | B1 * | 3/2005 | Griffin | 137/240 |

FOREIGN PATENT DOCUMENTS

| | | |
|---|---|---|
| DE | 29 49 413 | 6/1981 |
| DE | 38 08 542 | 10/1988 |
| DE | 41 32 891 | 4/1993 |
| DE | 42 14 839 | 11/1993 |
| DE | 196 01 308 | 7/1997 |

* cited by examiner

*Primary Examiner*—J. Casimer Jacyna
(74) *Attorney, Agent, or Firm*—Keusey, Tutunjian & Bitetto, P.C.

(57) ABSTRACT

A valve spring mechanism is provided which is suitable for use with the inlet or exhaust valves of an internal combustion engine, and includes a valve head and a valve stem. The mechanism includes a piston/cylinder arrangement in which the cylinder surrounds a portion of the valve stem to define a chamber. The piston is slidable and sealingly mounted on the valve stem. The mechanism also has force transmitting means for transmitting the force produced on the piston by gas pressure within the chamber to the valve stem, and a spring operating on the piston and the stem of the valve for applying a force to the stem tending to close the valve in the event of failure of chamber gas pressure. The spring is positioned to maintain it in a compressed condition during normal operation of the mechanism as a result of gas pressure within the chamber.

13 Claims, 2 Drawing Sheets

VALVE SPRING MECHANISM

FIELD OF THE INVENTION

This invention relates to a valve spring mechanism and in the preferred embodiment provides a valve spring mechanism suitable for use with the inlet and/or exhaust valves of an internal combustion engine. Whilst the particularly preferred application of the present invention is in the inlet and/or exhaust valve gear of an internal combustion engine it should be appreciated that the invention is not limited to such applications and may potentially be of use in other applications where poppet valves are provided with springs for the purposes of biasing the valve in one direction.

DESCRIPTION OF RELATED ART

The vast majority of internal combustion engines use poppet type valves as inlet valves and exhaust valves. Such valves comprise a head, which in use cooperates with a seat when the valve is in the closed position, and a stem which extends from the head to a position outside the combustion chamber and ports of the engine. The end of the valve stem remote from the head is acted upon by a valve operating mechanism (for example the cam shaft of an overhead cam engine) to open the valves. Whilst arrangements have been proposed in which both opening and closing movement of the valve is mechanically induced by means of a coupling between the valve stem and the valve operating mechanism, in the vast majority of engines a spring is used to bias the valve towards its closed position and a force is applied to the valve stem, for example by a cam, to move the valve against the spring bias when the valve is to be opened.

In most conventional engines the valve spring is a mechanical coil spring. It is well recognized, however, that mechanical coil springs suffer from a number of disadvantages particularly in high power and high-speed engines. Accordingly, a system has been developed whereby the elastic element of the valve spring mechanism is a compressed gas, typically compressed air. With such an arrangement, a fixed cylinder is fanned about the valve stem, and a piston, which works in the cylinder, is coupled to the valve stem itself. Compressed gas is supplied to the chamber defined between the piston and the cylinder, and the pressure of such gas acting on the piston biases the valve towards its closed position. When the valve is acted upon by its associated opening mechanism (for example, the cam of a camshaft) the piston moves with the valve stem to reduce the volume of the chamber defined between the piston and cylinder to compress the gas contained therein. The compressed gas, acting on the piston, maintains the valve in engagement with the cam as the cam moves to allow closing of the valve.

Whilst the use of a compressed gas as the elastic element of the spring mechanism offers many advantages, it does suffer from the disadvantage that correct operation of the valve gear is critically dependent on the existence of pressurized gas within the chamber of the spring mechanism. If there is no gas pressure present the valves may simply drop to their open position under the influence of gravity (in the case of an overhead valve or overhead cam engine) or not return to the closed position after being pushed to the open position by the operating mechanism. This can result in the valves coming into engagement with the pistons of the engine with resultant serious damage to the engine. The problem is particularly acute in the case of a motor vehicle engine which, for example, is subject to tow-starting after the vehicle has not been used for some time.

To avoid this problem it has been proposed to incorporate a spring within the gas chamber of the valve operating mechanism to ensure that some spring bias is maintained on the valve even if no gas pressure is present within the chamber. However providing a spring within the chamber in part negates the intention of the gas powered operating mechanism—that is to obviate the need for a mechanical valve spring. In order to reduce to a minimum the disadvantages of incorporating a mechanical spring within the chamber the springs are typically designed to be relatively light and only capable of operating the valve gear at low engine speeds. However, the springs still contribute to the moving mass of the valve gear and are liable to breakage after relatively short periods of usage.

SUMMARY OF THE INVENTION

It is the object of the present invention to provide a valve spring mechanism in which the primary elastic element is a compressed gas, which includes an auxiliary operating spring, but which does not suffer from the disadvantages outlined above.

According to a first aspect of the present invention there is provided a valve spring mechanism for a poppet valve which comprises a valve head and a valve stem, the mechanism comprising: a piston and cylinder arrangement in which the cylinder surrounds a portion of the valve stem, the piston is slidingly and sealingly mounted on the valve stem, and the piston and cylinder define a chamber; force transmitting means for transmitting the force produced on the piston by gas pressure within the chamber to the valve stem; and a spring operating on the piston and the stem of the valve for applying a force to the stem of the valve tending to close the valve in the event of failure of gas pressure within the chamber, the spring being positioned so that it is maintained in a compressed condition during normal operation of the valve spring mechanism as a result of gas pressure within the chamber.

Preferably, the force transmitting means comprises an abutment surface on the piston, which is normally maintained by gas pressure within the chamber in engagement with an abutment surface of an abutment member secured to the valve stem. Preferably, the spring is a coil compression spring, which surrounds the valve stem and acts at one end on the piston and at the other end on a seat member secured to the valve stem. Preferably, the seat member also constitutes the abutment member against which the abutment surface of the piston abuts in normal operation of the valve spring mechanism.

BRIEF DESCRIPTION OF THE DRAWINGS

The invention will be better understood from the following description of preferred embodiments thereof, given by way of example only, reference being had to the accompanying drawings wherein.

DETAILED DESCRIPTION OF PREFERRED EMBODIMENTS

Figure 1:
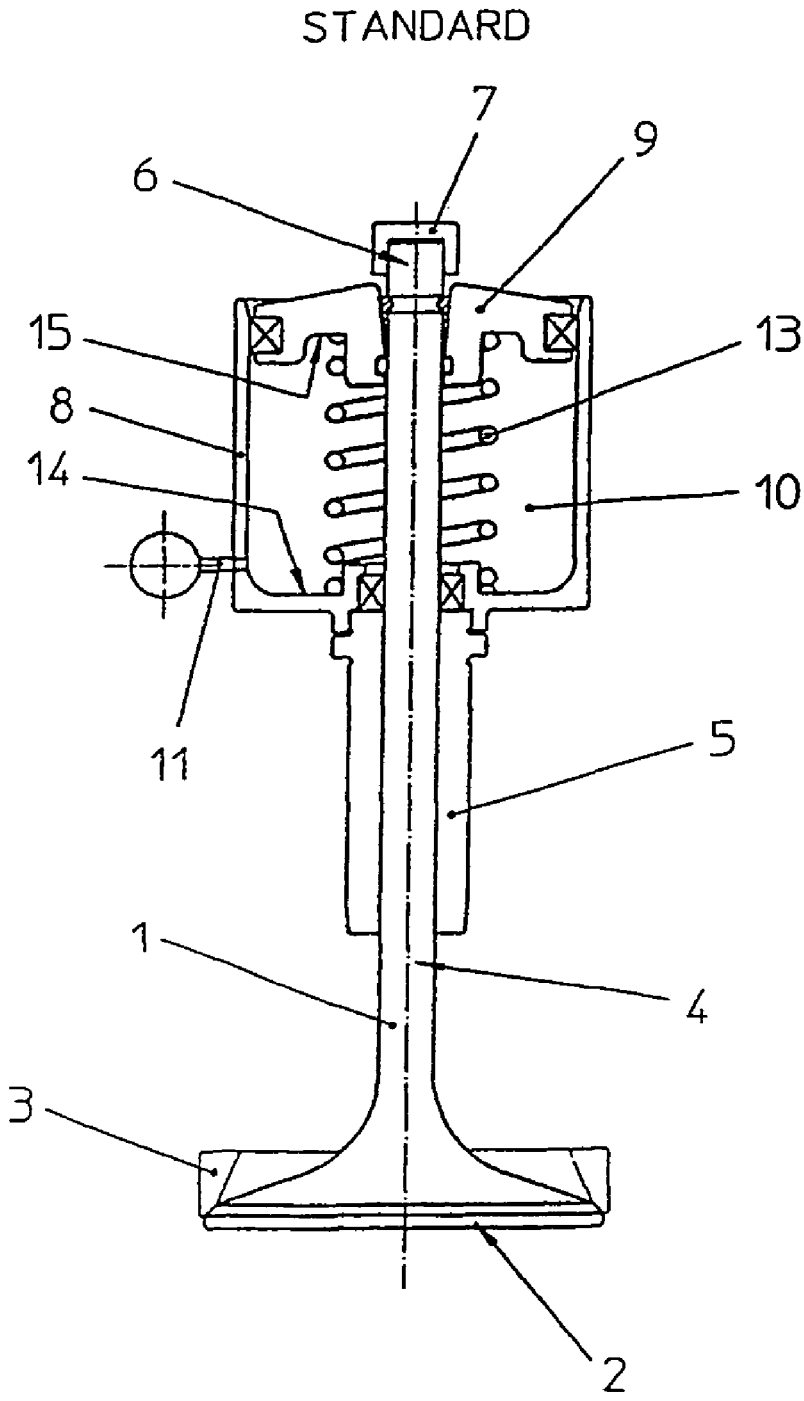
FIG. 1 is a schematic view of a valve spring operating mechanism of the prior art.

Referring firstly to FIG. 1, there is illustrated a poppet valve 1, which includes a head 2 for cooperating with a seat 3. The valve may be the inlet valve or the exhaust valve of an internal combustion engine. The valve 1 further includes a stem 4, which is slidably mounted in a guide 5 and has secured to the end 6 thereof remote from the head 2, a cap 7. A cylinder 8 is mounted surrounding the valve stem. A piston 9 is slidably mounted within the cylinder 8 and secured to the valve stem. Seals (not shown) provide a static seal between the piston 9 and the valve stem 4 and a sliding seal between the piston 9 and the interior surface of the cylinder 8. The piston and cylinder define a chamber 10 which, in normal use of the mechanism, is supplied with compressed air via an inlet 11.

In order to ensure that the valve is biased into the closed position in the event of an absence of gas pressure within the chamber 10, a spring 13 is located within the chamber 10 and acts between the base 14 of the cylinder and the underside 15 of the piston.

In normal use, gas pressure is maintained within the chamber 10 by suitable means, for example a compressor. Gas pressure within the chamber 10 acting on the underside 11 of the piston 9 produces an upward force (as viewed in FIG. 1) which is transferred to the valve stem to bias the valve towards its closed position. When the valve is to be opened, an appropriate force is applied to the cap 7 by suitable means (for example a cam shaft). This force pushes the valve 1 in the downward direction as viewed in FIG. 1 against the bias of the fluid pressure within the chamber 10 and the force of the spring 13. The spring 13 is accordingly compressed each time the valve is opened even though the intended purpose of the spring 13 is only to operate the valve in the event of the failure of gas pressure within the chamber 10. This repeated compression of the spring 13 on each operation of the valve means that the valve designer must make the spring 13 as light as possible consistent with satisfactory operation when it is required to be the sole means of moving the valve towards its closed position. Making the spring as light as possible means it is correspondingly less robust and it is liable to break after even a relatively short period of usage.

Figures 2, 3, 4, 5:
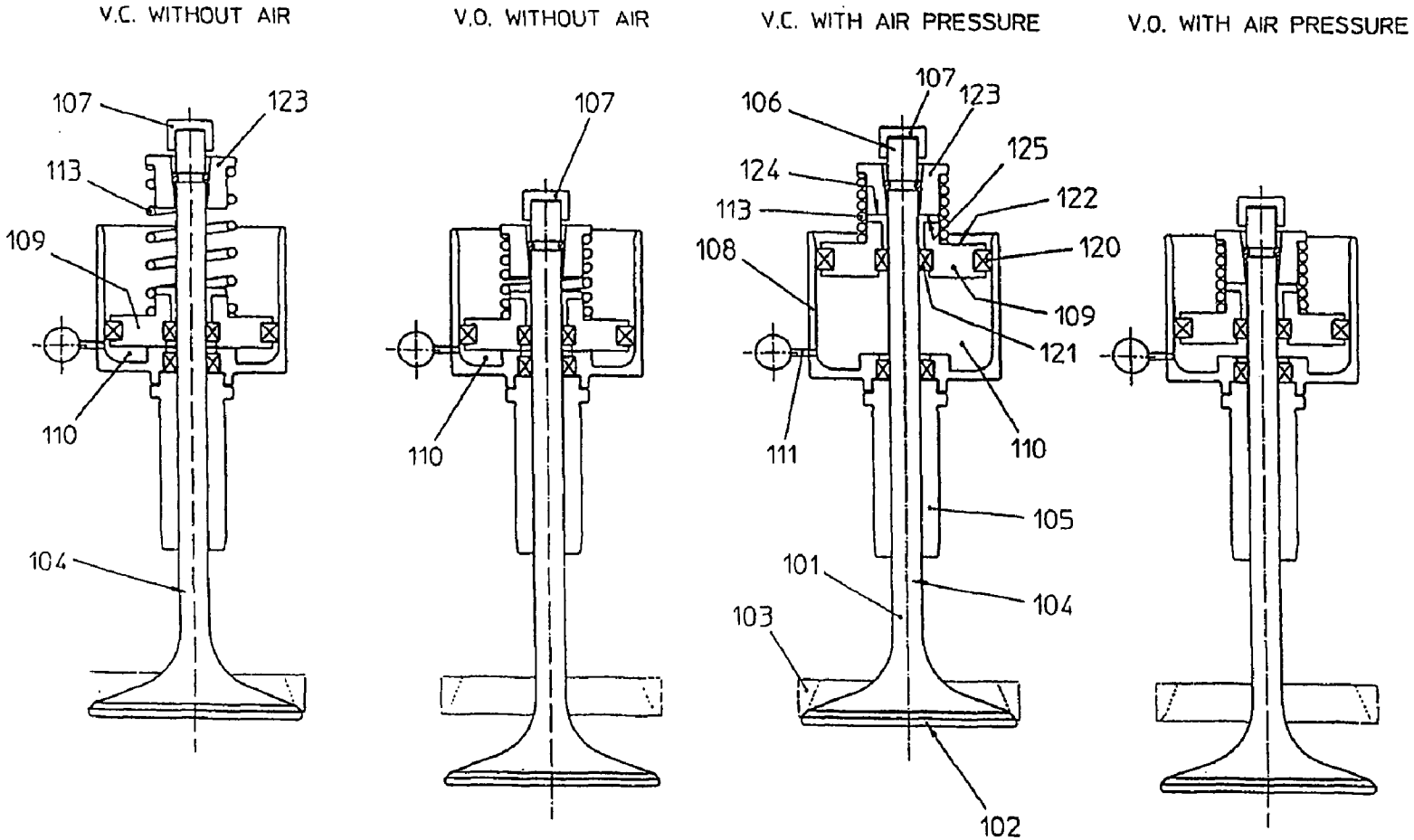
FIG. 2 illustrates a valve spring mechanism in accordance with a preferred embodiment of the present invention shown in its normal operating condition with the valve closed.
FIG. 3 is a view corresponding to FIG. 2 showing the valve in the open position.
FIG. 4 is a view of the mechanism of FIGS. 2 and 3 but showing the configuration of the components in the absence of gas pressure within the chamber and with the valve closed.
FIG. 5 is a view corresponding to FIG. 4 but showing the configuration of the components with the valve open.

Referring now to FIG. 2, there is illustrated an embodiment of the invention. In this embodiment, the valve 101 has a head 102 which, in use, cooperates with a seat 103. The valve stem 104 is slidably mounted in a guide 105 and is furnished at its end 106 remote from the head with a cap 107. The valve stem 104 is surrounded by a cylinder 108. A piston 109 is slidably mounted within the cylinder and a seal 120 is provided between the piston 109 and the cylinder 108. The piston and cylinder define a chamber 110.

In contrast to the arrangement illustrated in FIG. 1, in the arrangement of FIG. 2, the piston 109 is slidably mounted on the valve stem 104 and a sliding seal 121 is provided to maintain a gas tight seal between the piston 109 and the valve stem 104.

A valve spring 113 is located externally of the chamber 110 and acts between the upper surface 122 of the piston and a seat member 123, which is secured to the valve stem by any suitable means.

Under normal operation of the engine, gas pressure is supplied to the chamber 110 via an inlet 111 from suitable means, for example a compressor.

Under normal operating conditions of the engine, as illustrated in FIGS. 2 and 3, sufficient gas pressure is maintained within the chamber 110 to maintain an abutment surface 124 provided on the piston in engagement with an abutment surface 125 provided on the spring seat 123. With the surfaces 124 and 125 in contact with each other the spring 113 is substantially fully compressed and is coil-bound or close to coil-bound. Accordingly, as the valve is operated by means of its associated operating mechanism the piston 109 applies a force generated by the pressure within the chamber 110 to the valve stem via the abutment surfaces 124 and 125 and the abutment surfaces 124 and 125 remain in contact with each other throughout the range of possible positions of the valve. The valve is shown in its fully open configuration in FIG. 3. It will be noted that under all operating conditions the surfaces 124 and 125 remain in contact with each other and accordingly there is no extension or compression of the spring 113. Hence, the problem of the prior art in which the auxiliary ring 13 is repeatedly extended and compressed during normal operation of the valve gear is avoided.

In the event of failure of gas pressure within the chamber 110, for example as a result of prolonged storage of a vehicle without operation of the engine, the piston 109 will be driven by the spring 113 into the position illustrated in FIG. 4, when the valve is closed. The piston will, in effect, have bottomed against the lower surface of the cylinder and the spring 113 will have extended. The force applied by the spring 113 to the spring seat 123 will be applied to the valve stem 104 to maintain the Valve in the closed configuration. If, in the continued absence of pressure within the chamber 110, the valve is opened by application of a force to the cap 107, the spring 113 will be compressed during opening of the valve and will extend during subsequent closing of the valve to maintain the cap 107 in engagement with its associated driving mechanism. The valve, in its fully open position, and with no fluid pressure within the chamber 110, is illustrated in FIG. 5.

It will be noted from the above that during normal operation of the engine the spring 113 is simply maintained in a compressed state. The spring is not extended unless and until there is a failure of the gas pressure within the chamber 110. The designer is accordingly freed from the constraints of the prior art under which the spring 13 had to be designed to be repeatedly compressed and extended during normal operation of the engine. Also, failure of the spring as a result of repeated compression extension in normal use is avoided.

It will be appreciated that, in general, once an engine fitted with the valve gear described above has started a supply of compressed air, will immediately be directed to the chamber 110. Accordingly, the spring 113 will only be required to operate the valve during the initial moments of starting of the engine and as soon as sufficient gas pressure is built up within the chamber 110 the components will return to the relative positions illustrated in FIGS. 2 and 3 and thereafter the spring 113 will remain compressed during normal operation of the engine. Whilst in the above-described embodiment abutment surfaces 124 and 125 are provided for transmitting force from the piston to the valve, it will be appreciated that with appropriate design the spring 113 itself may be used as the force transmitting means to transmit normal operating forces from the piston to the valve stem. In order to utilize the spring 113 for this purpose, it will be designed so that it is fully compressed (coil bound) during normal operation of the engine. It will accordingly act as a solid cylindrical strut between the upper surface of the piston 109 and the spring seat 123. In the event of failure of gas pressure within the chamber 110 the spring will extend and operate as described above with reference to FIGS. 4 and 5.

The invention claimed is:

1. A valve spring mechanism for a poppet valve (101) that is capable of use on an internal combustion engine which comprises a valve head (102) and a valve stem (104), the mechanism comprising: a piston (109) and cylinder (108) arrangement in which the cylinder (108) surrounds a portion of the valve stem (104),the piston (109) is slidingly and sealingly mounted on the valve stem (104), and the piston (109) and cylinder (108) define a chamber (110); force transmitting means for transmitting the force produced on the piston (109) by gas pressure within the chamber (110) to the valve stem (104); and a spring (113) operating on the piston (109) and the stem of the valve for applying a force to the stem of the valve tending to close the valve in the event of failure of gas pressure within the chamber (110), the spring (113) being positioned so that it is maintained in a compressed condition during normal operation of the valve spring mechanism as a result of gas pressure within the chamber (110).

2. A valve spring mechanism according to claim 1 wherein the force transmitting means comprises an abutment surface on the piston which is normally maintained by gas pressure within the chamber in engagement with an abutment surface of an abutment member secured to the valve stem.

3. A valve spring mechanism according to claim 1 wherein the spring is a coil compression spring which surrounds the valve stem and acts at one end on the piston and the other end on a seat member secured to the valve stem.

4. A valve spring mechanism according to claim 3 wherein the seat member also constitutes the abutment member against which the abutment surface of the piston abuts in normal operation of the valve spring mechanism.

5. A valve spring mechanism according to claim 1 wherein the spring is external to the chamber.

6. A valve mechanism that is capable of use on an internal combustion engine comprising:

a piston and cylinder arrangement in which the cylinder surrounds a portion of the valve stem, the piston is slidingly and sealingly mounted on the valve stem, and the piston and cylinder define a chamber;

force transmitting means for transmitting the force produced on the piston by gas pressure within the chamber to the valve stem; and a spring operating on the piston and the stem of the valve for applying a force to the stem of the valve tending to close the valve in the event of failure of gas pressure within the chamber, the spring being positioned so that it is maintained in a compressed condition during normal operation of the valve spring mechanism as a result of gas pressure within the chamber.

7. A valve mechanism according to claim 6 wherein the force transmitting means comprises an abutment surface on the piston which is normally maintained by gas pressure within the chamber in engagement with an abutment surface of an abutment member secured to the valve stem.

8. A valve mechanism according to claim 7 wherein the spring bridges an interface between the piston and the abutment member.

9. A valve mechanism according to claim 7 wherein the valve stem is attached to the abutment member.

10. A valve mechanism according to claim 6 wherein the spring is external to the chamber.

11. A valve mechanism according to claim 6 wherein the spring is a coil compression spring which surrounds the valve stem and acts at one end on the piston and the other end on a seat member secured to the valve stem.

12. A valve mechanism according to claim 11 wherein the seat member also constitutes the abutment member against which the abutment surface of the piston abuts in normal operation of the valve spring mechanism.

13. A valve mechanism according to claim 6 wherein the valve mechanism includes a poppet valve.

* * * * *